US010307622B2

(12) United States Patent
Lawson et al.

(10) Patent No.: US 10,307,622 B2
(45) Date of Patent: Jun. 4, 2019

(54) HIGH-PRESSURE PASSTHROUGH FOR PROTECTIVE SUIT

(71) Applicant: Special Projects Operations, Inc., Belcamp, MD (US)

(72) Inventors: Kenneth Lawson, Ruckersville, VA (US); Brennan E. Hansen, Chesapeake, VA (US)

(73) Assignee: SPECIAL PROJECTS OPERATIONS, INC., Belcamp, MD (US)

( * ) Notice: Subject to any disclaimer, the term of this patent is extended or adjusted under 35 U.S.C. 154(b) by 639 days.

(21) Appl. No.: 15/098,981

(22) Filed: Apr. 14, 2016

(65) Prior Publication Data

US 2017/0296848 A1 Oct. 19, 2017

(51) Int. Cl.
*A62B 17/00* (2006.01)
*A62B 9/04* (2006.01)

(52) U.S. Cl.
CPC ..... *A62B 17/005* (2013.01); *A62B 17/006* (2013.01); *A62B 9/04* (2013.01)

(58) Field of Classification Search
CPC ..... A62B 17/00; A62B 17/006; A62B 17/008
See application file for complete search history.

(56) References Cited

U.S. PATENT DOCUMENTS 3,064,448 A 11/1962 Whittington
5,014,355 A * 5/1991 Vollenweider, II ..... A41D 13/0025 128/201.13
5,127,896 A 7/1992 de Gaston
5,293,864 A * 3/1994 McFadden ..... A62B 7/02 128/201.29
5,355,875 A 10/1994 Siegel
6,076,571 A * 6/2000 Burns ..... A62B 17/006 141/311 R
6,796,304 B2 * 9/2004 Odell ..... A62B 17/006 128/201.29
6,948,191 B2 9/2005 Avery et al.
7,310,999 B2 12/2007 Miller
7,748,380 B1 7/2010 Phifer et al.
7,802,322 B2 9/2010 Koch et al.
7,832,396 B2 11/2010 Abernethy
7,875,011 B2 1/2011 Harvie
9,000,913 B2 4/2015 Patil et al.
9,155,920 B1 10/2015 Billen
(Continued)

FOREIGN PATENT DOCUMENTS

GB 929897 6/1963

*Primary Examiner* — LaToya M Louis
(74) *Attorney, Agent, or Firm* — Whiteford, Taylor & Preston LLP; Gregory M. Stone

(57) ABSTRACT

A high-pressure passthrough apparatus and protective suit having a high-pressure passthrough is provided. A high-pressure passthrough having a penetrator body is connected to a protective suit, wherein a first half of the penetrator body is positioned exterior of the protective suit and a second half of the penetrator body is positioned interior of the suit. A high-pressure passthrough valve is positioned on the second half of the penetrator body, wherein high-pressured air is supplied to an interior space of the protective suit. Releasing the quantity of high-pressure air to the interior of the protective suit with the high-pressure passthrough valve may act to cool the interior of the protective suit.

14 Claims, 7 Drawing Sheets

(56) References Cited

U.S. PATENT DOCUMENTS

| | | | | |
|---|---|---|---|---|
| 2003/0024529 | A1 | 2/2003 | Beizndtsson et al. | |
| 2004/0237178 | A1 | 12/2004 | Landeros | |
| 2005/0062284 | A1 | 3/2005 | Schreiner et al. | |
| 2006/0096593 | A1 | 5/2006 | Grilliot et al. | |
| 2010/0199405 | A1 | 8/2010 | Nelson | |
| 2015/0128937 | A1* | 5/2015 | Teetzel ..... | A62B 7/10<br>128/202.22 |

* cited by examiner

HIGH-PRESSURE PASSTHROUGH FOR PROTECTIVE SUIT

FIELD OF THE DISCLOSURE

The present disclosure is generally related to passthrough devices and more particularly is related to high-pressure passthroughs for protective suits.

BACKGROUND OF THE DISCLOSURE

Protective suits such as chemical protective suits are used by emergency personnel to protect them against an array of toxic chemicals. These chemicals include blistering agents such as lewisite or mustard gas, choking agents such as phosgene (or CG as designated by the military), blood agents including cyanide based compounds such as hydrogen cyanide (AC), and nerve agents such as sarin, tabun, soman and others.

A variety of protective suits have been developed to protect wearers against the adverse effects of these chemicals as well as biological, nuclear and other environmental contaminants or conditions. The design aspects of these highly specialized suits depend largely upon their specific applications. However, if just trace amounts of these toxic vapors penetrate the chemical protective suit the result can be severe injury or death. Consequently, most all of such suits employ an external pressurized air source for introducing pressurized clean filtered breathable air into a self-contained breathing apparatus (SCBA) that the user wears while wearing the protective suit.

Since protective suits are durable and prevent air flow from the ambient atmosphere into the suit, the interior of the suits can often become uncomfortably hot. To counteract this problem, in some cases, protective suits may employ liquid cooling systems that circulate liquid coolant from an external source. Whether air, water, or other fluid, the fluid must be pumped into the suit or expelled therefrom through tubes which are connected at suit couplings, i.e., "passthrough" assemblies. These passthrough assemblies must safeguard the integrity of the suit, especially in the chemical warfare context which often requires a hermetic seal. In such cases the couplings must be of the highest integrity and provide maximum protection against contamination. The designer must be cognizant of the fact that many chemical warfare agents are specifically intended for maximum penetration at seams and couplings.

While these types of cooling systems may provide some relief from the uncomfortable temperature a user experiences while wearing a protective suit, these systems require a supply of a cooling material, whether gas or liquid, and the necessary components to circulate the cooling material throughout the suit. Accordingly, unnecessary weight and bulkiness is added to the suit. Further, since the protective suits are often worn in harsh chemical environments, using potentially chemically-contaminated ambient air as a cooling material is highly undesired since it risks exposing the user to the chemical environment he or she is using the suit to be protected from.

Thus, a heretofore unaddressed need exists in the industry to address the aforementioned deficiencies and inadequacies.

SUMMARY OF THE DISCLOSURE

Embodiments of the present disclosure provide a system and method for a high-pressure passthrough apparatus.

Briefly described, in architecture, one embodiment of the apparatus, among others, can be implemented as follows. A penetrator body is connectable to a chemical suit. A high-pressure inlet is positioned on a first side of the penetrator body. A high-pressure self-contained breathing apparatus (SCBA) outlet is positioned on a second side of the penetrator body. A high-pressure passthrough valve is positioned on the second side of the penetrator body.

The present disclosure can also be viewed as providing a protective suit having a high-pressure passthrough. Briefly described, in architecture, one embodiment of the system, among others, can be implemented as follows. A high-pressure passthrough having a penetrator body is connected to a protective suit, wherein a first half of the penetrator body is positioned exterior of the protective suit and a second half of the penetrator body is positioned interior of the protective suit. A high-pressure passthrough valve is positioned on the second half of the penetrator body, wherein high-pressure air is supplied to an interior space of the protective suit.

The present disclosure can also be viewed as providing methods of supplying a quantity of high-pressure air to an interior of a chemical protective suit. In this regard, one embodiment of such a method, among others, can be broadly summarized by the following steps: supplying a quantity of high-pressure air to a first side of a high-pressure passthrough positioned on an exterior of a chemical protective suit; and releasing at least a portion of the quantity of high-pressure air to an interior of the chemical protective suit with a high-pressure passthrough valve, wherein the high-pressure passthrough valve further comprises a service pressure range of between 300 PSI and 6,500 PSI.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

The subject disclosure is directed to a system and method for a high-pressure passthrough in a protective suit to cool an interior of the protective suit or provide other benefits, such as over-pressurization of the protective suit. As described herein, the present disclosure may significantly improve upon the conventional systems for cooling a protective suit by utilizing high-pressure gas, namely breathing gas, which is required by the SCBA used with the protective suit. Accordingly, the subject disclosure may be capable of cooling the protective suit without the use of bulky components to circulate the cooling material throughout the suit or using an ambient air supply as a cooling medium.

Figure 1:
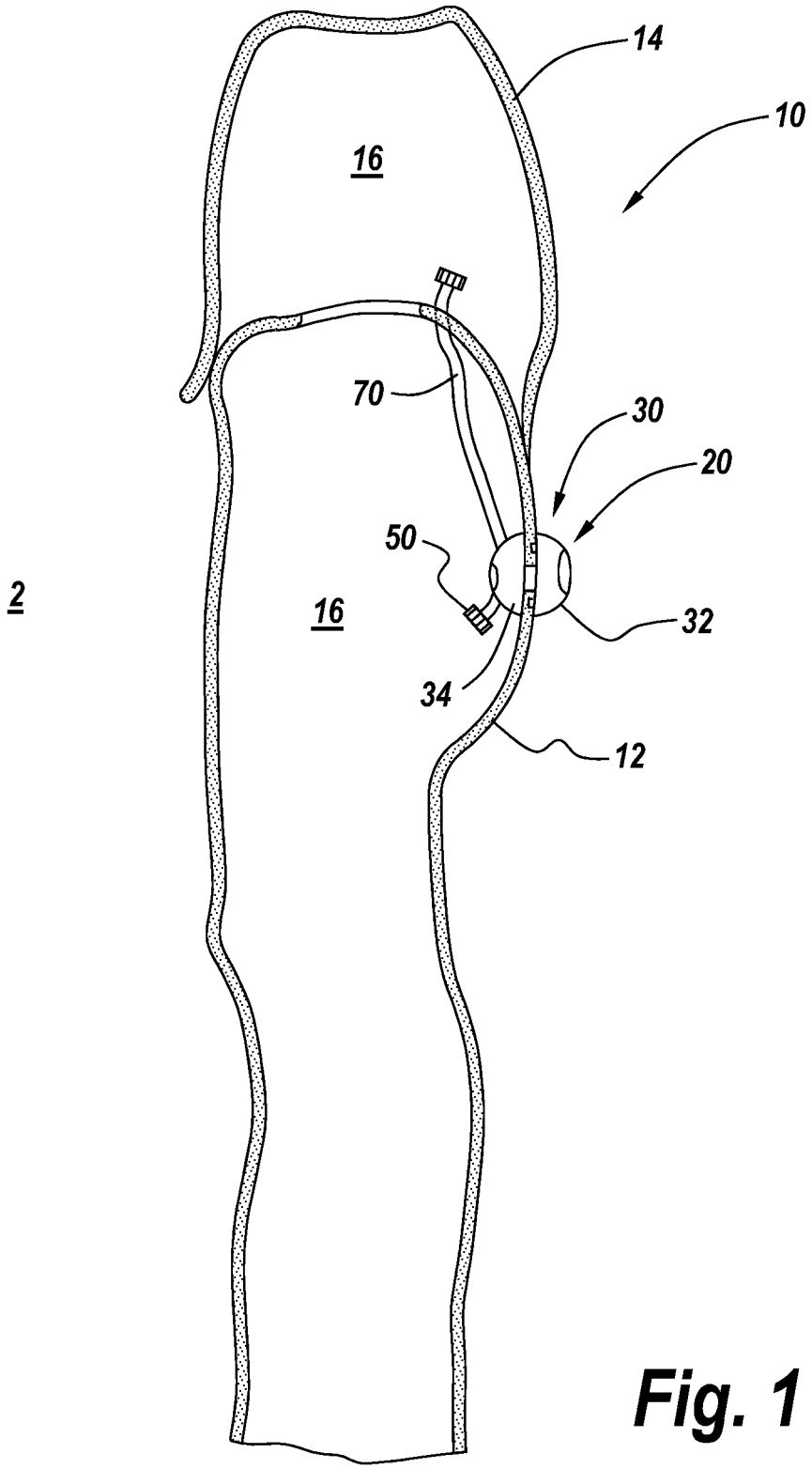
FIG. 1 is a cross-sectional illustration of a protective suit having a high-pressure passthrough, in accordance with a first exemplary embodiment of the present disclosure.

FIG. 1 is a cross-sectional illustration of a protective suit 10 having a high-pressure passthrough 20, in accordance with a first exemplary embodiment of the present disclosure. The protective suit 10 may generally include a garment that is capable of protecting a human being from a harmful environment, commonly chemical environments where the human being would be exposed to chemicals which could injure or kill a human being. While the subject disclosure uses a chemically protective suit 10 as a primary example, it is noted that protective suits 10 used in other environments are also considered within the scope of the present disclosure. In one example, the protective suit 10 generally includes a body portion 12 with a head portion 14 connected to the body portion 12 with an airtight connection. The head portion 14 may be a full head apparatus, a facemask, or similar device which can provide the user with SCBA capabilities, such that the user can breathe air supplied from a compressed or filtered source, such as air tanks or air cylinders. The body portion 12 and head portion 14 may each have interior portions 16 which can be in fluid communication with one another or separated from one another. All portions of the protective suit 10 may be sealed against an outside atmosphere 2, including at the foot holes, wrist holes, or any other places. The protective suit 10 may be constructed from any materials conventionally used in the industry and may include any other features of conventional suits, including communication devices, hermetic closure devices, life-support devices, etc.

The high-pressure passthrough 20 may generally refer to the apparatus which allows compressed breathing gas to be brought into the protective suit 10 and allows for a portion of the high-pressure gas to be passthrough into the interior portion 16 of the protective suit 10. The high-pressure passthrough 20 generally includes a penetrator body 30 connected to the protective suit 10. The penetrator body 30 includes a first half 32 or first part which is positioned exterior of the protective suit 10 and a second half 34 or second part which is positioned interior of the protective suit 10, i.e., inside the interior portion 16. A SCBA feed line 70 may be connected to the second half 34 by a quick connect to supply a quantity of breathing gas to the head portion 14. The quick connect may include an FD17 series high-pressure quick disconnect coupling device, for instance. A high-pressure passthrough valve 50 is positioned on the second half 34 and supplies a quantity of high-pressure breathing gas to the interior space 16 of the protective suit 10. The high-pressure breathing gas, when released into the interior space 16, is a lower temperature than ambient air due to the high-pressurization of the breathing gas within cylinders. The infusion of the high-pressure gas into the interior space 16 acts to cool the interior space 16 due to the rapid decompression of the gas and provide for a more comfortable environment for the wearer of the protective suit 10.

It is noted that various protective suits and SCBAs used conventionally in the industry include the ability to convert high-pressure gas to a low pressure, but only in positions fully outside of the protective suit. These type of devices decrease the gas pressure from high to low prior to the gas moving through the passthrough. In contrast, the subject disclosure allows for the transfer of high-pressure gas through the high-pressure passthrough 20, e.g., at a PSI of above 300, and once it is inside the protective suit 10, the high-pressure gas may be decreased to a low pressure as needed for an SCBA and cooling.

Figure 2:
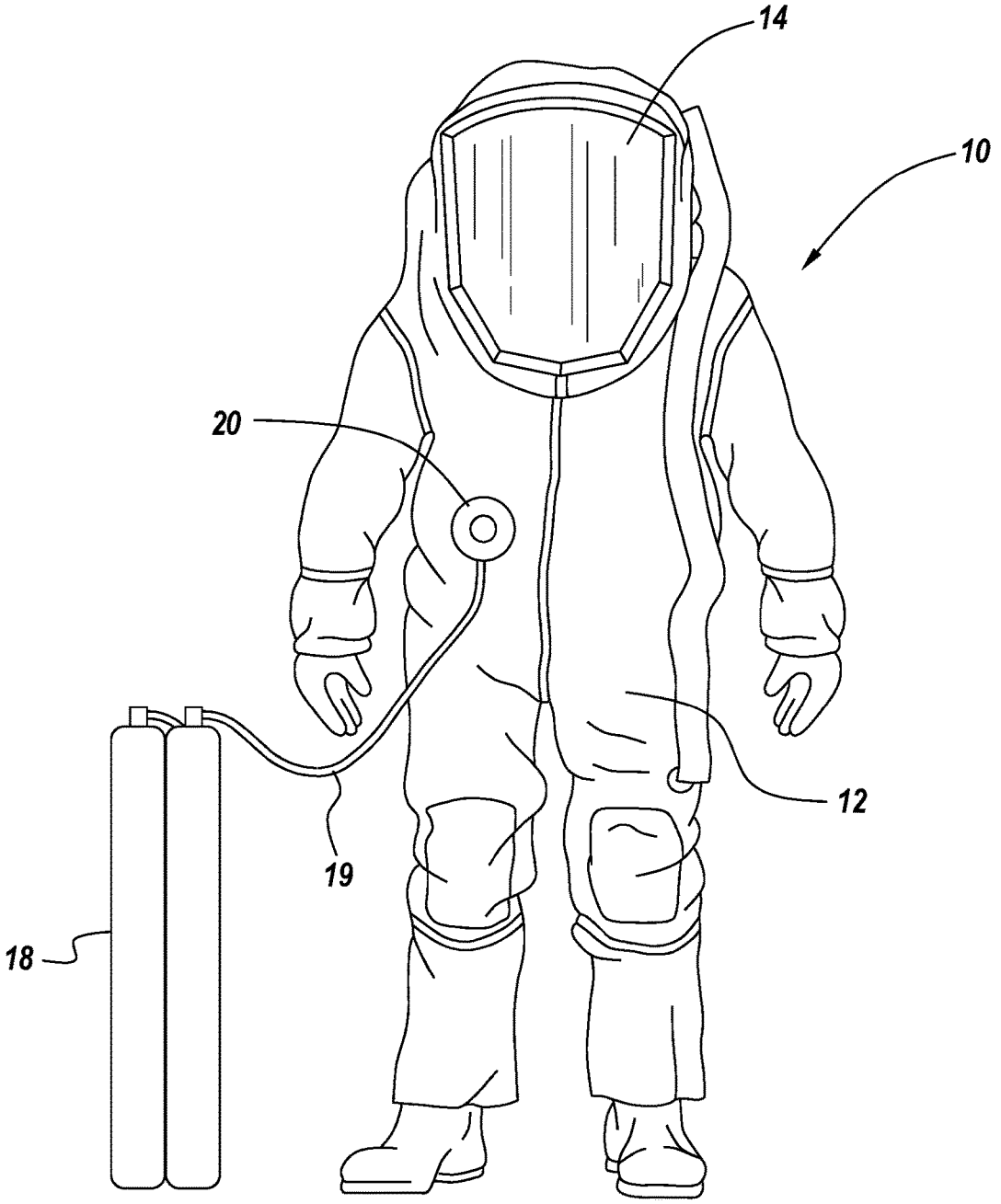
FIG. 2 is a front view illustration of the protective suit having the high-pressure passthrough, in accordance with the first exemplary embodiment of the present disclosure.

FIG. 2 is a front view illustration of the protective suit 10 having the high-pressure passthrough 20, in accordance with the first exemplary embodiment of the present disclosure. As shown in FIG. 2 but relative to both FIGS. 1-2, the high-pressure passthrough 20 positioned on the protective suit 10 may be connected to any number of external cylinders 18 having a quantity of compressed breathing gas. The cylinders 18 may be connected to the high-pressure passthrough 20 with a high-pressure gas line 19 to supply the breathing gas to the high-pressure passthrough 20. The external cylinders 18 may be carried on a backpack of the wearer of the protective suit 10 (not shown). It is noted that the subject disclosure is specifically directed to using high-pressure which may be generally understood as gas that is significantly pressurized above atmospheric air pressure. Within the industry, pressure between 0-300 PSI is generally understood as low pressure, whereas pressure above 300 PSI may be viewed as high-pressure, which includes pressures on the lower end of the scale, e.g., 300 PSI to 900 PSI and pressures that are greater, e.g., 900 PSI to approximately 6,500 PSI. The pressure in which the apparatus 20 is intended to operate is above 300 PSI, or more preferably, above 900 PSI. Accordingly, the high-pressure gas may have a pressurization of substantially between 300 PSI and 6,500 PSI, preferably between 900 PSI and 6,500 PSI. Other ranges and levels of high-pressure gas are also included within the scope of the present disclosure.

Figure 3:
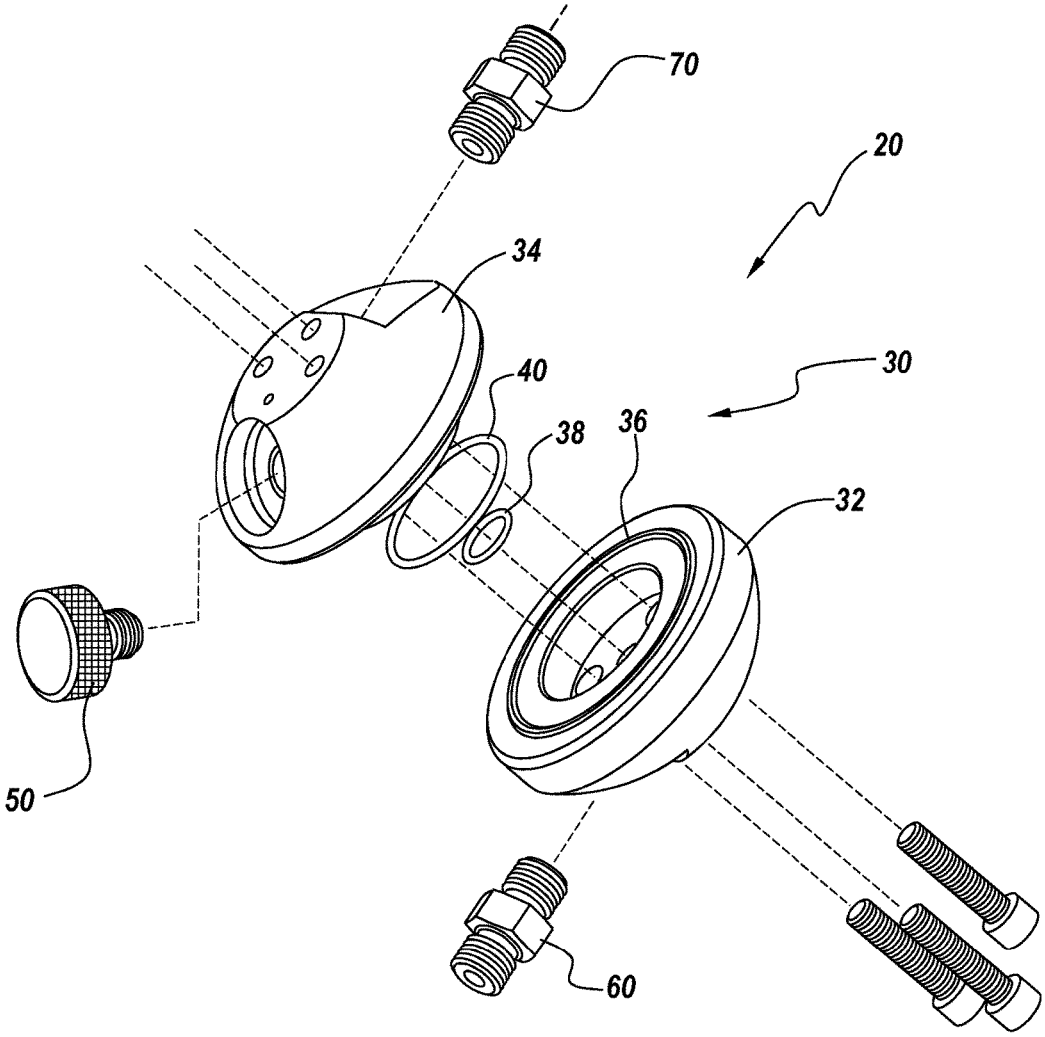
FIG. 3 is an exploded schematic illustration of the high-pressure passthrough, in accordance with the first exemplary embodiment of the present disclosure.
Figure 4:
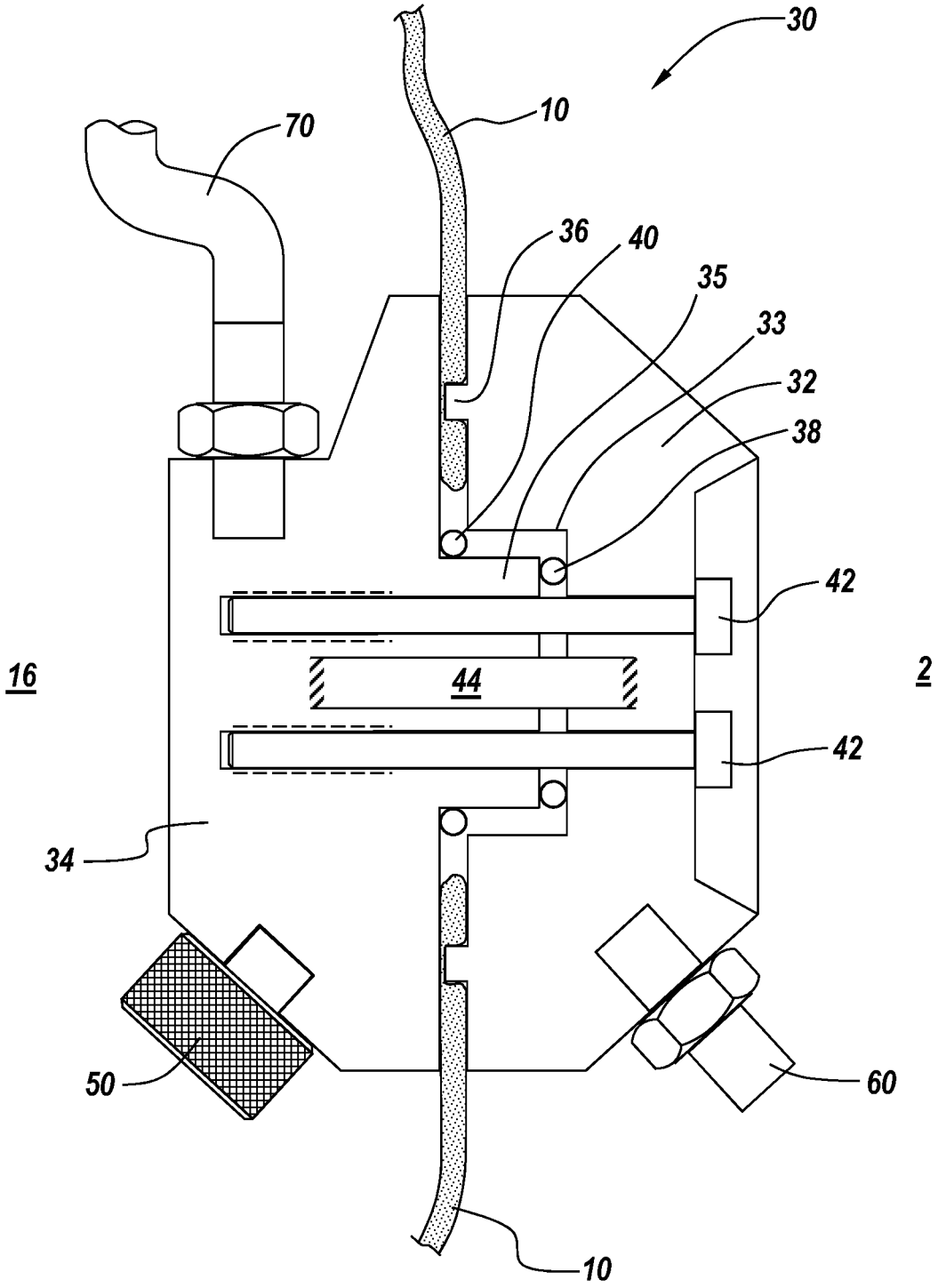
FIG. 4 is a detailed, cross-sectional side view illustration of the high-pressure passthrough in use with a protective suit, in accordance with the first exemplary embodiment of the present disclosure.

FIG. 3 is an exploded schematic illustration of the high-pressure passthrough 20, in accordance with the first exemplary embodiment of the present disclosure. FIG. 4 is a detailed, cross-sectional side view illustration of the high-pressure passthrough 20 in use with a protective suit 10, in accordance with the first exemplary embodiment of the present disclosure. Relative to FIGS. 3-4, the high-pressure passthrough 20, which may also be referred to herein as 'high-pressure passthrough apparatus 20' or 'apparatus 20' includes a penetrator body 30 connectable to a protective suit 10 (FIG. 4), such as a chemical suit. The first half 32 and second half 34 of the penetrator body 30 may be durable structures capable of withstanding the harsh conditions to which the protective suit 10 may be exposed. In one example, the first and second halves 32, 34 are constructed from 7075 aluminum and may have a surface treatment positioned on one or more surfaces thereof. For example, the surface treatment may include a hard coat anodizing and/or polytetrafluoroethylene (TEFLON®) flash-coating.

A high-pressure inlet 60 which receives a quantity of high-pressure gas, such as from high-pressure gas cylinders, is positioned on a first side of the penetrator body 30, on the first half 32 (FIG. 1). The first side of the penetrator body 30 may be the side that is positioned exterior of the protective suit 10 and that contacts the ambient atmosphere 2. On the second side of the penetrator body 30, e.g., on the second half 34 (FIG. 1) which is positioned interior of the protective suit 10 and within the interior portion 16, a high-pressure self-contained breathing apparatus (SCBA) outlet 70 is connected to the penetrator body 30. A high-pressure passthrough valve 50 is also positioned on the second side (second half 34) of the penetrator body 30 such that it is positioned within the interior space 16 of the protective suit 10.

When the penetrator body 30 is positioned on the protective suit 10 with the first half 32 positioned on an exterior side and the second half 34 positioned on an interior side, the penetrator body 30 may be hermetically sealed to ensure that there is no air leak through the penetrator body 30 or between a connection of the penetrator body 30 with the protective suit 10. For example, a hermetically sealed engagement may be provided between the first and second halves 32, 34 using a number of different structures. One of the first and second halves 32, 34 may include a raised boss 36 positioned on an interior edge of either the first or second half 32, 34 to provide exceptional sealing against the protective suit 10 material, as shown in FIG. 4.

Additionally, a high-pressure sealing O-ring 38 and/or a secondary/environmental O-ring 40 may be positioned between the first and second halves 32, 34. Here, the high-pressure O-ring 38 may maintain the high-pressure connection between the first and second halves 32, 34, while the secondary O-ring 40 may prevent infiltration of ambient atmosphere from gaining access to the interior of the penetrator body 30. As shown in FIG. 4, the O-rings 38, 40 may be positioned proximate to a protrusion 35 of the second half 34 which fits within a cavity 33 of the first half 32. A number of threaded connectors 42 or fasteners may be used to secure the two halves 32, 34 together and to retain the O-rings 38, 40 in their proper positions. The threaded connectors 42 may be positioned through holes in the first half 32 and threadedly engage with threaded holes in the second half 34, the connection of which may be toleranced sufficiently to prevent air leakage.

The penetrator body 30 may include appropriate ducting and gas flow structures 44 to allow high-pressure air introduced in the high-pressure inlet 60 to be passed from the first half 32 to the second half 34, and to the SCBA feed line 70 and the high-pressure passthrough valve 50. The ducting and gas flow structures 44 are schematically shown in FIG. 4, but it is noted that structures beyond what are depicted would be used to properly convey the pressurized gas through the high-pressure passthrough 20.

The high-pressure passthrough valve 50 may be capable of receiving the high-pressure gas from the high-pressure inlet 60 and releasing a portion of that high-pressure gas into the interior portion 16 of the protective suit 10. While the specifics of the high-pressure gas may vary, it is noted that the high-pressure passthrough valve 50 may have a service pressure range of between 300 PSI and 6,500 PSI, preferably between 900 PSI and 6,500 PSI, among other ranges not specifically identified herein.

While the present disclosure may offer benefits beyond what are explicitly disclosed herein, the ability to use the high-pressure gas already required for SCBA use with protective suits to cool the interior of the protective suit may significantly improve the use of protective suits. Other benefits may also include the ability to over pressurize or supply a positive pressure within the protective suit. Having a positive pressure within the protective suit may, for example, help prevent infiltration of chemicals within an inadvertent hole or puncture within the protective suit. In this example, the positive pressure may immediately create an airflow from the interior of the protective suit to the outside atmosphere through a hole or puncture, which may prevent chemicals from entering through the hole or puncture.

Figure 5:
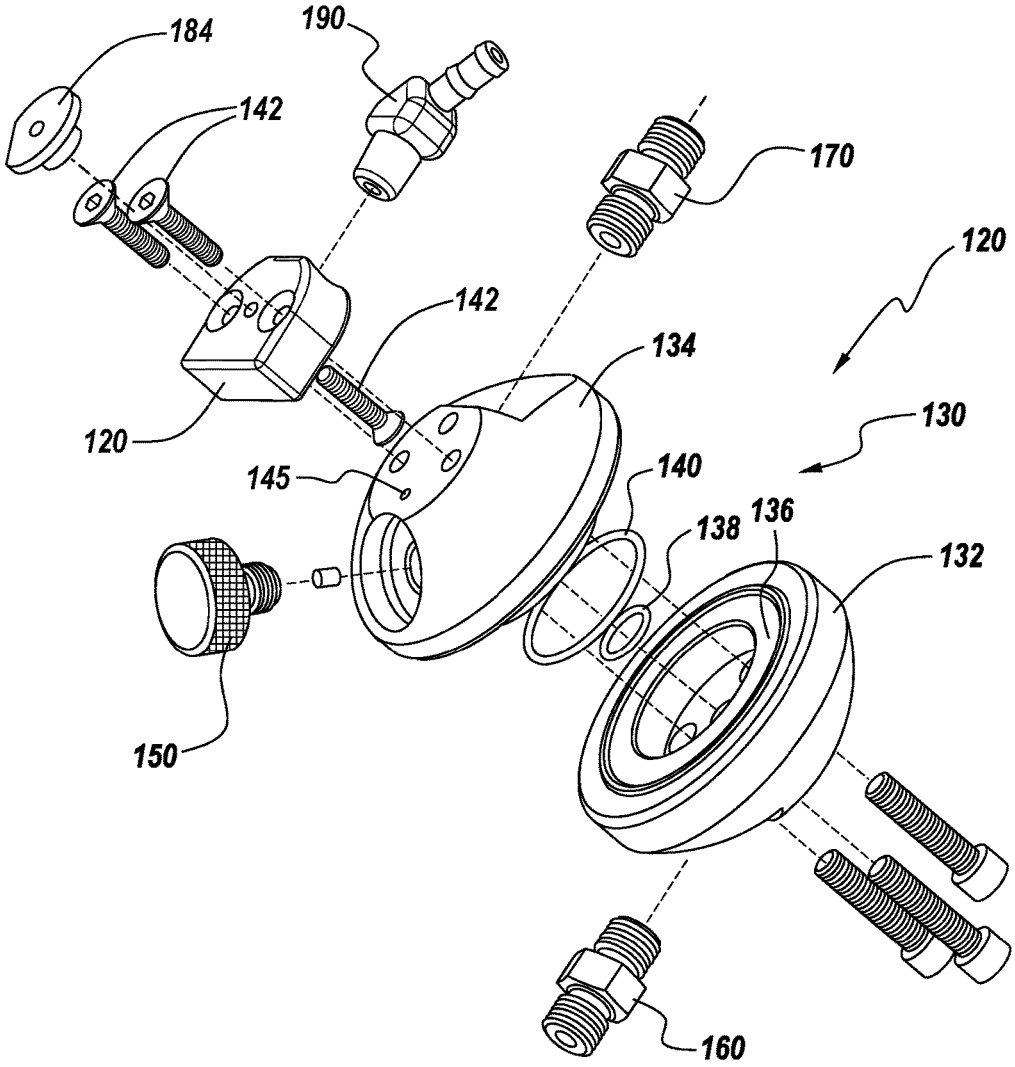
FIG. 5 is an exploded schematic illustration of the high-pressure passthrough, in accordance with a second exemplary embodiment of the present disclosure.
Figure 6:
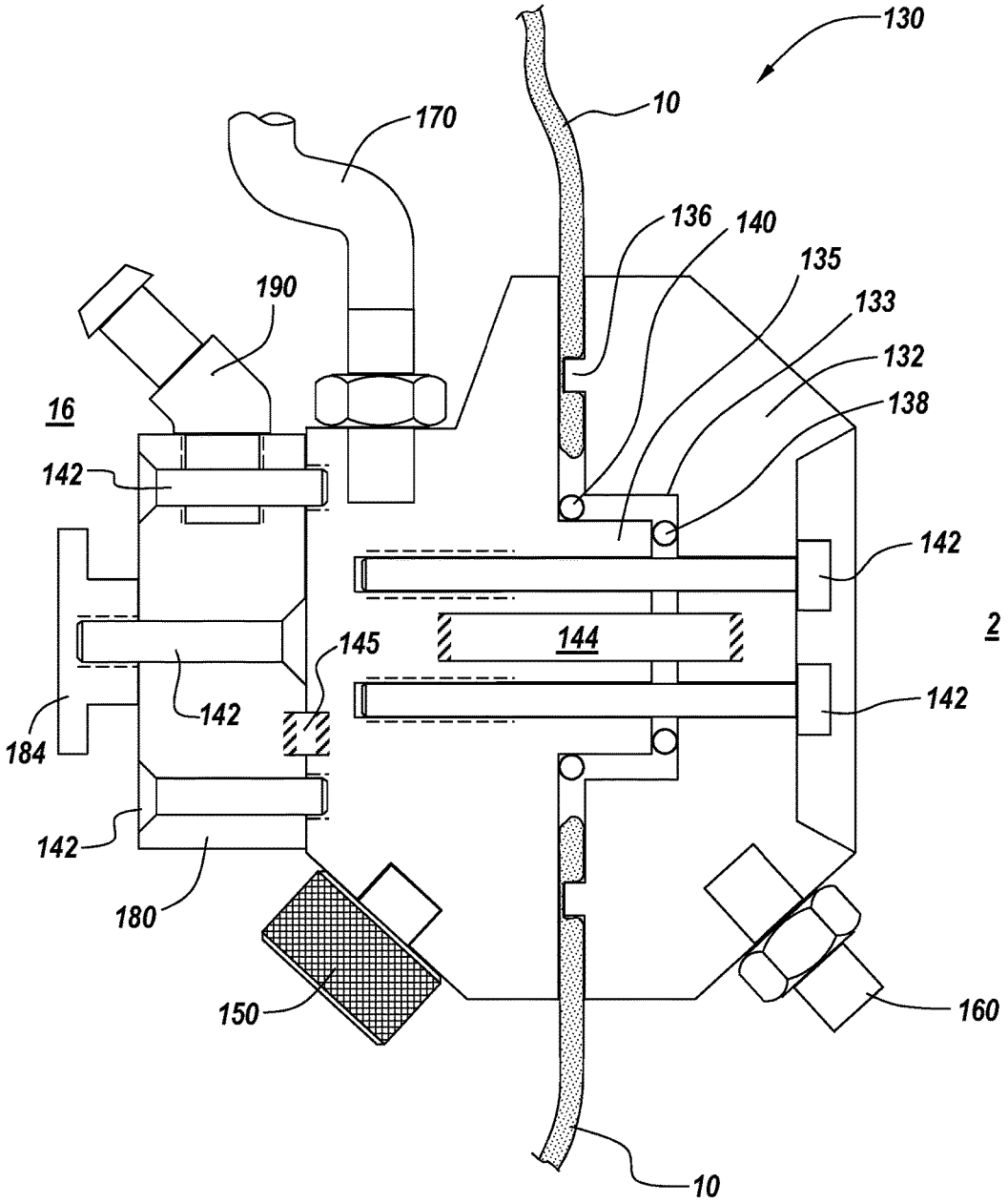
FIG. 6 is a detailed, cross-sectional side view illustration of the high-pressure passthrough in use with a protective suit, in accordance with the second exemplary embodiment of the present disclosure.

FIG. 5 is an exploded schematic illustration of the high-pressure passthrough 120, in accordance with a second exemplary embodiment of the present disclosure. FIG. 6 is a detailed, cross-sectional side view illustration of the high-pressure passthrough 120 in use with a protective suit 10, in accordance with the second exemplary embodiment of the present disclosure. The second exemplary embodiment may be substantially similar to the first exemplary embodiment and may include any of the features disclosed relative to the first exemplary embodiment. Relative to FIGS. 5-6, the high-pressure passthrough 120, which may also be referred to herein as 'high-pressure passthrough apparatus 120' or 'apparatus 120' includes a penetrator body 130 connectable to a protective suit 10 (FIG. 6), such as a chemical suit. The first half 132 and second half 134 of the penetrator body 130 may be durable structures capable of withstanding the harsh conditions to which the protective suit 10 may be exposed. In one example, the first and second halves 132, 134 are constructed from 7075 aluminum and may have a surface treatment positioned on one or more surfaces thereof. For example, the surface treatment may include a hard coat anodizing and/or polytetrafluoroethylene (TEFLON®) flash-coating.

A high-pressure inlet 160 which receives a quantity of high-pressure gas, such as from high-pressure gas cylinders, is positioned on a first side of the penetrator body 130, on the first half 132 (FIG. 1). The first side of the penetrator body 130 may be the side that is positioned exterior of the protective suit 10 and that contacts the ambient atmosphere 2. On the second side of the penetrator body 130, e.g., on the second half 134 (See, e.g., FIG. 1) which is positioned interior of the protective suit 10 and within the interior portion 16, a high-pressure self-contained breathing apparatus (SCBA) outlet 170 is connected to the penetrator body 130 with a quick connect device. A high-pressure passthrough valve 150 is also positioned on the second side (second half 134) of the penetrator body 130 such that it is positioned within the interior space 16 of the protective suit 10.

When the penetrator body 130 is positioned on the protective suit 10 with the first half 132 positioned on an exterior side and the second half 134 positioned on an interior side, the penetrator body 130 may be hermetically sealed to ensure that there is no air leak through the penetrator body 130 or between a connection of the penetrator body 130 with the protective suit 10. For example, a hermetically sealed engagement may be provided between the first and second halves 132, 134 using a number of different structures. One of the first and second halves 132, 134 may include a raised boss 136 positioned on an interior edge of either the first or second half 132, 134 to provide exceptional sealing against the protective suit 10 material, as shown in FIG. 6.

Additionally, a high-pressure sealing O-ring 138 and/or a secondary/environmental O-ring 140 may be positioned between the first and second halves 132, 134. Here, the high-pressure O-ring 138 may maintain the high-pressure connection between the first and second halves 132, 134, while the secondary O-ring 140 may prevent infiltration of ambient atmosphere from gaining access to the interior of the penetrator body 130. As shown in FIG. 6, the O-rings 138, 140 may be positioned proximate to a protrusion 135 of the second half 134 which fits within a cavity 133 of the first half 132. A number of threaded connectors 142 or fasteners may be used to secure the two halves 132, 134 together and to retain the O-rings 138, 140 in their proper positions. The threaded connectors 142 may be positioned through holes in the first half 132 and threadedly engage with threaded holes in the second half 134, the connection of which may be toleranced sufficiently to prevent air leakage.

The penetrator body 130 may include appropriate ducting and gas flow structures 144 to allow high-pressure air introduced in the high-pressure inlet 160 to be passed from the first half 132 to the second half 134, and to the SCBA feed line 170 and the high-pressure passthrough valve 150. The ducting and gas flow structures 144 are schematically shown in FIG. 6, but it is noted that structures beyond what are depicted would be used to properly convey the pressurized gas through the high-pressure passthrough 120.

In addition to what is shown in FIGS. 3-4, the apparatus 120 of FIGS. 5-6 may include an adapter block 180 which is positioned on the interior side 16 of the protective suit 10 and acts to redirect airflow from the second half 134. The adapter block 180 may be secured to the rear face of the second half 134 with threaded connectors 142. On the rear face of the adapter block 180, a belt clip 184 may be included to allow the apparatus 120 to clip to a belt worn by the user. The belt clip 184 may be connected to the adapter block 180 with a threaded connector 142. A hose barb fitting 190 may be connectable to the adapter block 180 to allow the high-pressure gas to be directed through cooling tubes (not shown) within a protective suit 10, which may be used with or in place of air cooling of the protective suit 10 as described relative to FIGS. 3-4. The hose barb fitting 190 may include a barbed end to allow the end of a hose to easily connect to the apparatus 120.

The high-pressure passthrough valve 150 and the adapter block 180 may be capable of receiving the high-pressure gas from the high-pressure inlet 160 and releasing a portion of that high-pressure gas into the interior portion 16 of the protective suit 10. After the high-pressure gas is moved through the ducting and gas flow structures 144 between the first and second halves 132, 134, it may be directed through additional ducting and gas flow structures, such as a cooling air passage 145 positioned between the second half 134 and the adapter block 180. While the specifics of the high-pressure gas may vary, it is noted that the high-pressure passthrough valve 150 may have a service pressure range of between 300 PSI and 6,500 PSI, preferably between 900 PSI and 6,500 PSI, among other ranges not specifically identified herein.

While the present disclosure may offer benefits beyond what are explicitly disclosed herein, the ability to use the high-pressure gas already required for SCBA use with protective suits to cool the interior of the protective suit may significantly improve the use of protective suits. Other benefits may also include the ability to over pressurize or supply a positive pressure within the protective suit. Having a positive pressure within the protective suit may, for example, help prevent infiltration of chemicals within an inadvertent hole or puncture within the protective suit. In this example, the positive pressure may immediately create an airflow from the interior of the protective suit to the outside atmosphere through a hole or puncture, which may prevent chemicals from entering through the hole or puncture.

Figure 7:
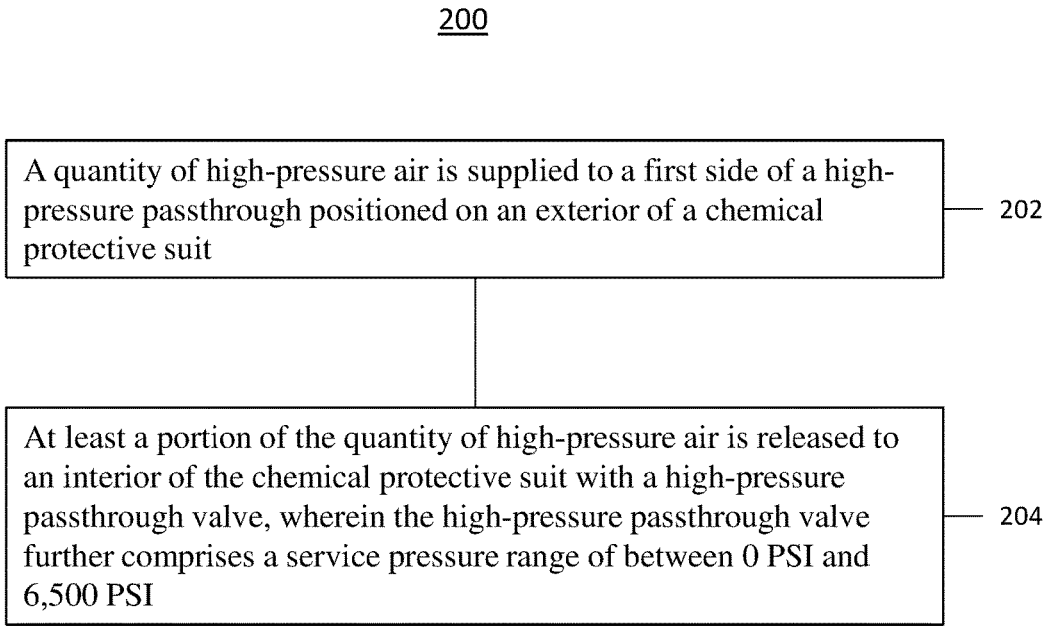
FIG. 7 is a flowchart illustrating a method of supplying a quantity of high-pressure air to an interior of a chemical protective suit, in accordance with a third exemplary embodiment of the disclosure.

FIG. 7 is a flowchart 200 illustrating a method of supplying a quantity of high-pressure air to an interior of a chemical protective suit, in accordance with a third exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 202, a quantity of high-pressure air is supplied to a first side of a high-pressure passthrough positioned on an exterior of a chemical protective suit. At least a portion of the quantity of high-pressure air is released to an interior of the chemical protective suit with a high-pressure passthrough valve, wherein the high-pressure passthrough valve further comprises a service pressure range of between 300 PSI and 6,500 PSI (block 204). It is noted that the method may include any number of additional steps, processes, or functions, including any disclosed relative to any other figure of this disclosure. For example, at least a second portion of the quantity of high-pressure air may be released to the SCBA unit while the high-pressure gas is also released through the high-pressure passthrough valve. Further, the service pressure range of the high-pressure passthrough valve may be between 900 PSI and 6,500 PSI. While there may be a number of benefits that the present disclosure offers, the use of high-pres sure gas emitted through the passthrough valve may be used to cool the interior of the chemical protective suit. For example, it may also be used to provide a positive pressure within the protective suit.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A high-pressure passthrough apparatus comprising:

a penetrator body connectable to a chemical suit, wherein the penetrator body comprises a first half positionable on an exterior side of the chemical suit and a second half positionable on an interior side of the chemical suit when the penetrator body is connected to the chemical suit;

a high-pressure inlet positioned on the first half of the penetrator body receiving high pressure gas from a high pressure source;

a high-pressure self-contained breathing apparatus (SCBA) outlet positioned on the second half of the penetrator body receiving air from the high-pressure inlet and supplying air to a head portion of the chemical suit; and a high-pressure passthrough valve positioned on the second half of the penetrator body within an interior space of the suit and receiving high pressure gas from the high-pressure inlet, wherein high pressure gas is supplied to the interior space of the chemical suit through the high-pressure passthrough valve, and wherein the high-pressure passthrough valve further comprises a service pressure range of between 900 PSI and 6,500 PSI.

2. The high-pressure passthrough apparatus of claim 1, further comprising a hermetically sealed engagement between the first and second halves, wherein the hermetically sealed engagement comprises a raised boss on at least one of the first and second halves.

3. The high-pressure passthrough apparatus of claim 1, further comprising at least one O-ring positioned between the first and second halves.

4. The high-pressure passthrough apparatus of claim 1, further comprising at least one threaded connector removably engaged between the first and second halves.

5. The high-pressure passthrough apparatus of claim 1, wherein the penetrator body further comprises a surface treatment, the surface treatment being at least one of:

a hard coat anodizing and polytetrafluoroethylene flash-coating.

6. The high-pressure passthrough apparatus of claim 1, wherein the high-pressure passthrough valve releases a quantity of high-pressure air into the interior space of the chemical suit when the penetrator body is connected to the chemical suit.

7. A protective suit having a high-pressure passthrough comprising:

a protective suit;

a high-pressure passthrough having a penetrator body connected to the protective suit, wherein a first half of the penetrator body is positioned exterior of the protective suit and receives high pressure gas from a high pressure source, and a second half of the penetrator body is positioned interior of the protective suit;

a high-pressure self-contained breathing apparatus (SCBA) outlet positioned on the second half of the penetrator body and receiving air from the first half of the penetrator body and supplying air to a head portion of the protective suit; and a high-pressure passthrough valve positioned on the second half of the penetrator body within an interior space of the protective suit, wherein high-pressured air is supplied to the interior space of the protective suit through the high-pressure passthrough valve, and wherein the high-pressure passthrough valve further comprises a service pressure range of between 900 PSI and 6,500 PSI.

8. The protective suit of claim 7, wherein the protective suit further comprises a chemical protective suit.

9. The protective suit of claim 7, further comprising a hermetically sealed engagement between the first and second halves, wherein the hermetically sealed engagement comprises a raised boss on at least one of the first and second halves.

10. The protective suit of claim 9, further comprising at least one O-ring positioned between the first and second halves.

11. The protective suit of claim 7, further comprising at least one threaded connector removably engaged between the first and second halves.

12. A method of supplying a quantity of high-pressure air to an interior of a chemical protective suit, the method comprising:

supplying a quantity of high-pressure air from a high pressure source to a first half of a high-pressure passthrough positioned on an exterior of a chemical protective suit;

receiving said quantity of high-pressure air from said first side of said high-pressure passthrough at a second half of said high-pressure passthrough positioned on an interior of said chemical protective suit;

releasing at least a first portion of the quantity of high-pressure air to a self-contained breathing apparatus (SCBA) outlet positioned on said second half of said high-pressure passthrough and supplying said first portion to a head portion of the chemical protective suit; and releasing at least a second portion of the quantity of high-pressure air to an interior space of the chemical protective suit with a high-pressure passthrough valve, wherein the high-pressure passthrough valve further comprises a service pressure range of between 900 PSI and 6,500 PSI.

13. The method of claim 12, wherein releasing the portion of the quantity of high-pres sure air to the interior of the chemical protective suit with the high-pressure passthrough valve cools the interior of the chemical protective suit.

14. The method of claim 12, wherein the quantity of high-pressure air released to the interior of the chemical protective suit with the high-pressure passthrough valve further comprises a quantity of air compressed above atmospheric air pressure.

* * * * *